US007874028B2

(12) United States Patent
Bradford

(10) Patent No.: US 7,874,028 B2
(45) Date of Patent: Jan. 25, 2011

(54) SOFA PROTECTOR AND BEDDING SUBSTITUTE

(76) Inventor: Kenneth Clark Bradford, 17373 Campbell Rd. #17, Dallas, TX (US) 75252

( * ) Notice: Subject to any disclaimer, the term of this patent is extended or adjusted under 35 U.S.C. 154(b) by 0 days.

(21) Appl. No.: 11/879,539

(22) Filed: Jul. 17, 2007

(65) Prior Publication Data

US 2008/0060132 A1 Mar. 13, 2008

Related U.S. Application Data

(60) Provisional application No. 60/843,743, filed on Sep. 11, 2006.

(51) Int. Cl.
*A47G 9/00* (2006.01)

(52) U.S. Cl. ..... 5/502; 5/482; 5/485; 5/495; 5/497; 5/498

(58) Field of Classification Search ..... 5/482, 5/485, 490, 494, 495, 497, 501, 502; 297/219.1, 297/225, 228.11, 229
See application file for complete search history.

(56) References Cited

U.S. PATENT DOCUMENTS 2,586,031 A * 2/1952 Hahne ..... 5/485
4,651,370 A * 3/1987 Vitale ..... 5/407
5,438,719 A * 8/1995 Anthony ..... 5/485
5,566,411 A * 10/1996 Eiler ..... 5/494
5,732,424 A * 3/1998 Bond ..... 5/502
5,996,147 A * 12/1999 Trimble ..... 5/482
6,108,836 A * 8/2000 Keene, III ..... 5/497
6,122,781 A * 9/2000 Stephenson ..... 5/482
6,490,741 B1 * 12/2002 Wheeler ..... 5/494
2007/0214569 A1 * 9/2007 Miller ..... 5/482

* cited by examiner

*Primary Examiner*—Robert G Santos
*Assistant Examiner*—Nicholas Polito
(74) *Attorney, Agent, or Firm*—Jeffrey Roddy

(57) ABSTRACT

An easily laundered one piece sofa protector and bedding substitute for couches and sofas having a fitted sheet type element conjoined to a flat sheet in such a way to stay in place while the sofa occupant sleeps. Alternately, the flat sheet may be pulled away from the fitted sheet and laid against the back sofa cushions to protect them from soiling. Additionally, a sewn in pouch for the temporary retention of a typical throw pillow is provided so that the throw pillow may be used as a sleeping pillow without soiling the surface of the throw pillow.

17 Claims, 4 Drawing Sheets

SOFA PROTECTOR AND BEDDING SUBSTITUTE

CROSS REFERENCE TO RELATED APPLICATIONS

This application claims the benefit of U.S. Provisional Application No. 60/843,743 filed Sep. 11, 2006

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

BACKGROUND OF THE INVENTION

The present invention relates to a convenient one piece couch or sofa covering such as may be used for overnight guests and will easily convert any conventional sofa into comfortable bedding. Additionally, the present invention may be utilized to protect the back cushions of a sofa by folding the top sheet back and against the sofa's back cushions.

Often the household couch or sofa becomes the guest bed of necessity when faced with limited accommodations. It is common practice to take two bed sheets and fashion a temporary bedding solution for the sofa and while this solves the immediate problem, it has many disadvantages; the top sheet, bottom sheet, or both often pull away during sleep from the couches cushions. Additionally, there are two sheets to be laundered instead of one, and even the best arranged substitute bedding can have a disheveled appearance. There is a need for an affordable and easily laundered bedding substitute sized specifically for couches and sofas that will retain both the bottom and top sheet in an efficient manner while protecting the upholstery. Furthermore, it is desirable that this bedding substitute provide the option for the use of a typical throw pillow as a sleeping pillow while protecting said pillow from soiling.

U.S. Pat. No. 3,789,441 issued to Weiss shows a fitted sheet for mattresses and studio couches, but is unlike the present invention as it has no top sheet.

U.S. Pat. No. 4,384,380 issued to Glaha, et al., shows a fitted double sheet for beds, the conjoined parts thereof attached at the foot end of the fitted sheet and is unlike the present invention because the top flap is sewn at the foot end, whereas the top sheet of the present invention is sewn in at the side, rendering it generally suitable for use as a couch surface protector and specifically as a sleeping cover for couches. Furthermore, it makes no reference of a sewn in pillow pocket that serves to retain a typical throw pillow thus protecting the pillow's surface while used as a sleeping pillow.

U.S. Pat. No. 6,618,881 issued to Hart, et al., shows a quilted covering for furniture. It is unlike the present invention as it has no provision for cushion retention.

U.S. Pat. No. 6,883,193 issued to Brooks, et al., shows another type of fitted bed sheet without reference to a top sheet U.S. Publication No. 20050034236 by Te Selle, et al., shows a fitted sheet type futon mattress cover that is intended to go over a futon mattress as a protector of the underlying surface, and is unlike the present invention as it makes no reference to a top sheet separate from the fitted sheet.

BRIEF SUMMARY OF THE INVENTION

The present invention is a one piece sofa protector and bedding substitute that provides a suitably sized fitted sheet for the retention of a single or multiple numbers of sofa seat cushions and a top sheet that resists removal and repositioning during sleep. The top sheet is affixed to the fitted sheet in such a way as to allow the top sheet to be folded against the back sofa cushions to protect the same when the sofa is being used to sit upon. The fitted sheet portion of the present invention is easily pulled over the tops of the seat cushions in the same manner one would place a fitted sheet on a bed. Elastic banding at mitered corners serves to retain the fitted sheets position snuggly. The top sheet portion which shares an interior long side with the fitted sheet portion has a fold line lengthwise to the couch, so that it will not fall off or bunch down at the occupant's feet during sleep. Alternately, this fold line also makes it possible for the top sheet to be pulled away from the fitted sheet and against the back sofa cushions so that it may guard the surface of the same.

An object of the present invention is to provide an easily laundered bedding substitute for a couch or sofa.

Another object of the present invention is to provide a means to protect the seat and back cushions of a sofa or couch from soiling from kids or pets.

A further object of the present invention is to provide a means to use a typical throw pillow as a head pillow for sleeping while protecting the upholstery of same.

Still another object of the present invention is to provide a tidy appearance when not in use so that it may be left in place every day of a multi-night sleepover.

The applicant is not aware of any previously described art having the features and advantages of the present invention.

DETAILED DESCRIPTION OF THE INVENTION

Figure 1:
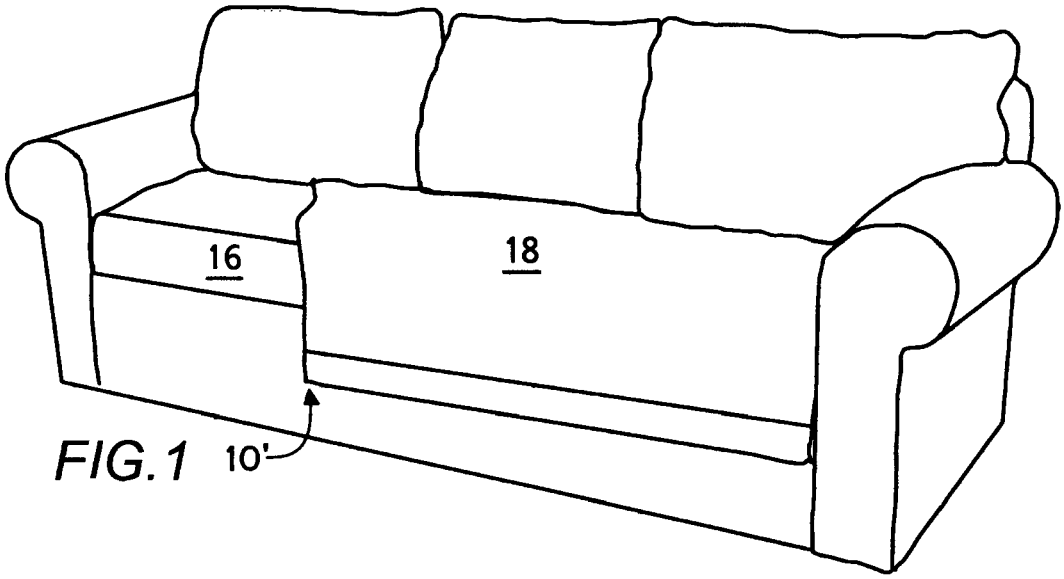
FIG. 1 is a perspective view of one preferred embodiment of the sofa covering in typical use.

FIG. 1 Illustrates a perspective view of the sofa protector 10' in typical use showing the fitted sheet part 16, and the top sheet 18 part pulled down part way, revealing the top of the fitted sheet part 16.

Figure 2:
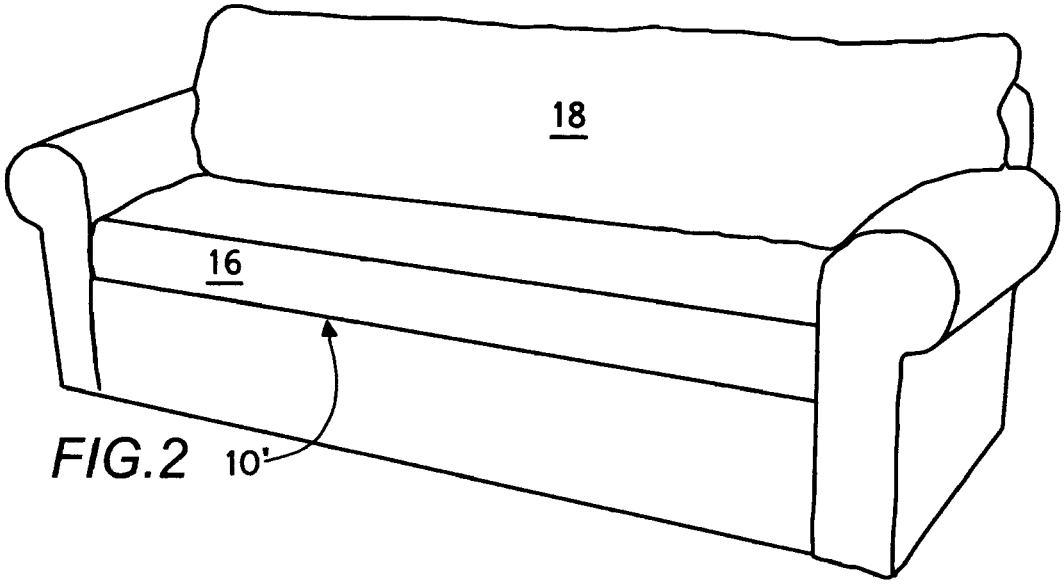
FIG. 2 is a perspective view of another embodiment of the sofa covering in typical use with the flat sheet pulled back and laid against the back cushions.

FIG. 2 Illustrates a perspective view of an embodiment of the couch protector in typical use showing the flat sheet pulled away from the fitted sheet part and laid against the sofa's back cushions. In this arrangement the back cushions are protected from soiling by pets, children, etc.

Figure 3:
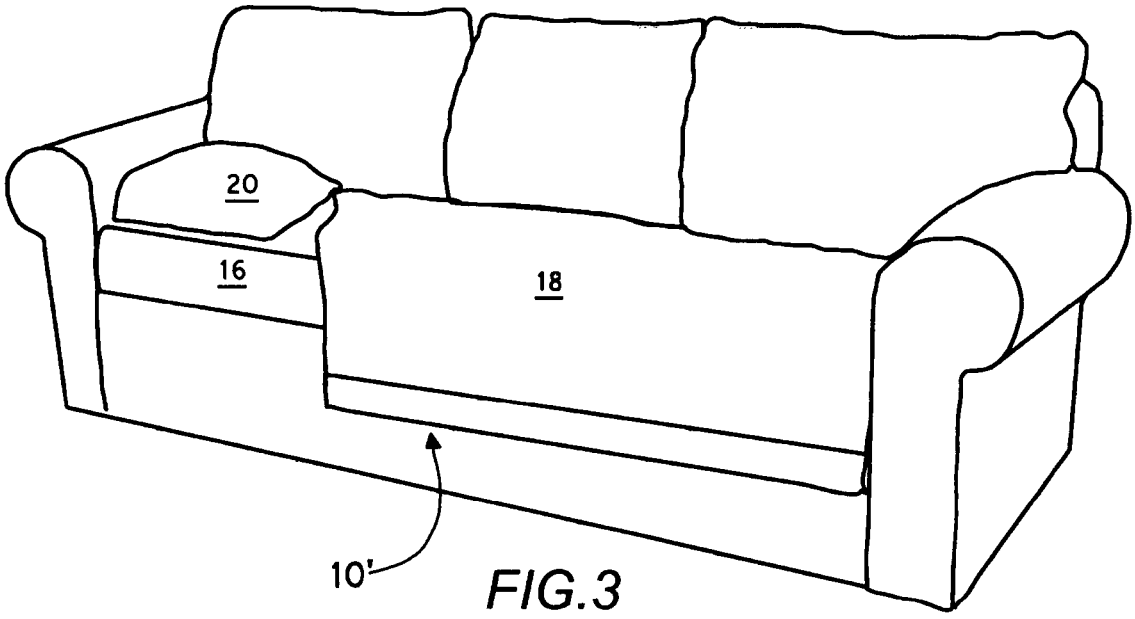
FIG. 3 is a perspective view of another embodiment of the sofa covering in typical use.

FIG. 3 illustrates a perspective view of an alternate embodiment of the sofa protector in typical use showing the fitted sheet part 16 and the flat sheet part 18 along with a sewn in pillow pouch 20, shown with throw pillow inserted. In this arrangement a throw pillow may be temporarily slid into a pocket to be used as a head pillow, while protecting the fabric of the throw pillow from soiling.

Figure 4:
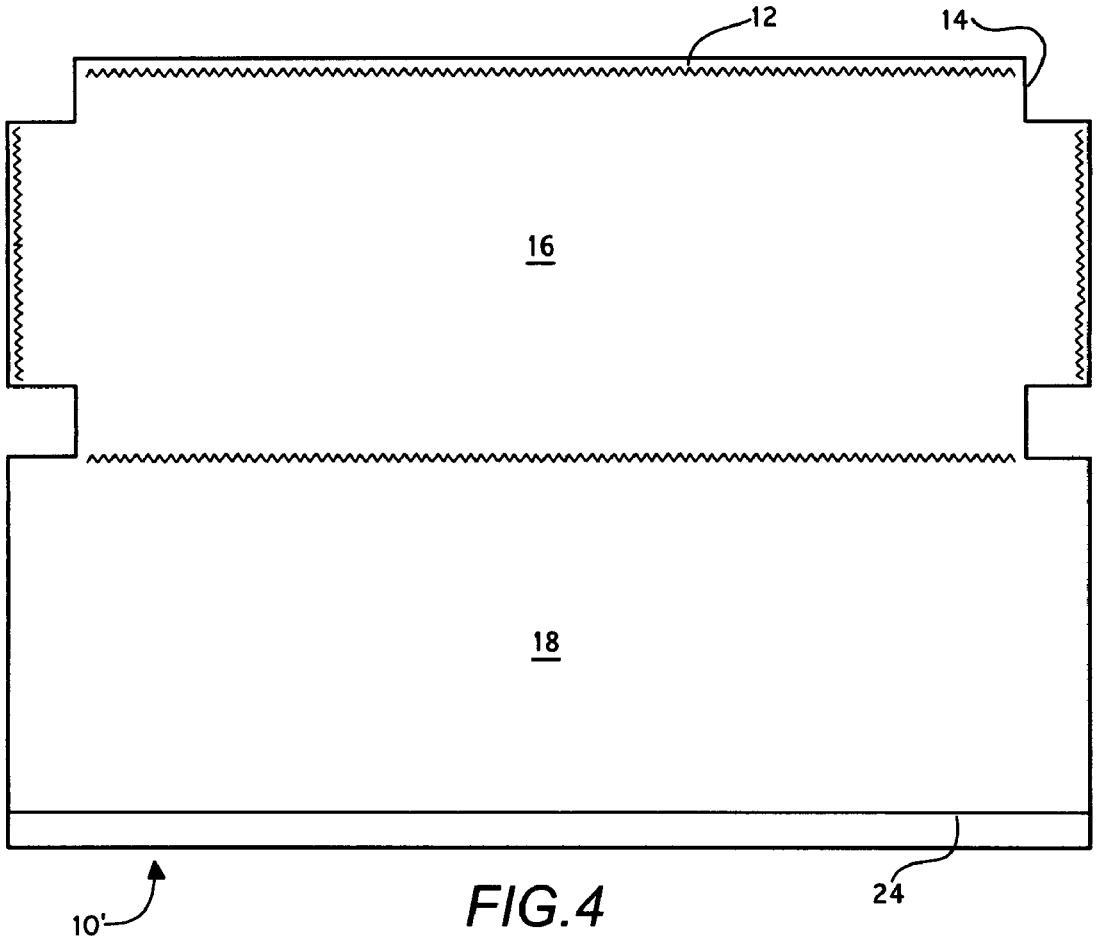
FIG. 4 shows a plan view of one embodiment of the present invention with the mitered corners before sewn condition.

FIG. 4 illustrates a plan view of the sofa protector 10, before sewing showing the mitered corners 14 of the fitted sheet part 16 and the position of the sewn in elastic banding 12. Also shown is the top sheet part 18 and hem 24.

Figure 5:
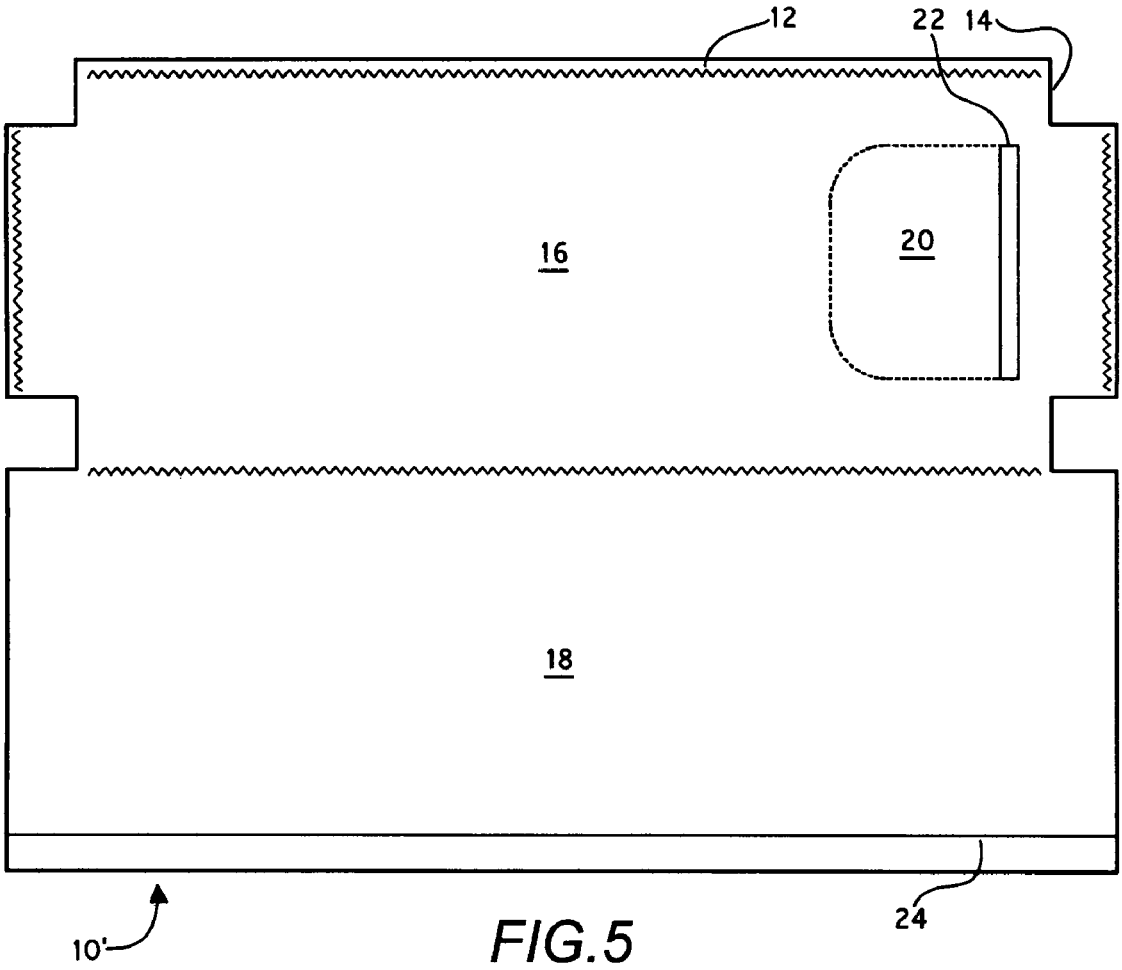
FIG. 5 shows a plan view of another embodiment of the present invention with the mitered corners before sewn condition and the position of the sewn in pillow pouch.

FIG. 5 illustrates a plan view of an alternate embodiment the sofa protector 10', and shows a sewn in pillow pocket 20 on the top side of the flat sheet 18 for the temporary insertion of a throw pillow for use as a head pillow in sleeping. Also shown is the hem line 22 of the pillow pocket.

While the invention has been described in connection with only three principal embodiments, it is not intended to limit the scope of the invention to the particular form set forth, but on the contrary, it is intended to cover such alternatives, modifications, and equivalents as may be included within the spirit and scope of the invention as defined by the appended claims.

I claim:

1. A one piece sofa protector and bedding substitute comprising:

a fitted sheet part being disposed to cover sofa seat cushions, said fitted sheet part having four corners, a long side, and two short sides wherein said four corners are mitered to form cavities for the reception of corners of said sofa seat cushions;

a flat sheet part for the covering of a sleeping person in a first position, and alternately covering back cushions of a sofa in a second position the flat sheet part having a long side, and two short sides, and the length of the long side of the flat sheet part exceeding the length of the fitted sheet part once sewn, and the flat sheet part unconjoined along said short sides of said fitted sheet part; and, a folding line parallel to said long side of said fitted sheet part lengthwise of a sofa, formed where said fitted sheet part and said flat sheet part are together conjoined, and along which said line said flat sheet part is foldably swept between said first position and said second position; and, the flat sheet part in which said long side is capable of assuming a position substantially parallel to said folding line while in said second position covering the entirety of said back cushions.

2. The sofa protector of claim 1 wherein an elastic band is sewn along said four corners and entire length of said long side of said fitted sheet part and along said folding line where said fitted sheet part and said flat sheet part are conjoined.

3. The sofa protector of claim 1 wherein said sofa protector is constructed of one or more pieces of fabric.

4. The sofa protector of claim 1 wherein said sofa protector is constructed of a single piece of fabric.

5. The sofa protector of claim 1 wherein said fitted sheet part has an integrated sewn in pocket to accommodate a variety of throw pillows.

6. The sofa protector of claim 1 with an added four sided pillow case to retain variously shaped couch or throw pillows.

7. The sofa protector of claim 1 wherein the fitted sheet part is padded with a quilted layer.

8. The sofa protector of claim 1 wherein said folding line is less in length than the longitudinal length of said flat sheet part.

9. A one piece sofa protector and bedding substitute comprising:

a fitted sheet part (16) having a length and width, and being disposed to cover sofa seat cushions, said fitted sheet having four corners, a long side, and two short sides wherein said four corners are mitered and sewn to form cavities for the reception of the corners of said sofa seat cushions;

a flat sheet part (18) having a long side, and two short sides, a portion of the flat sheet part contiguous with the fitted sheet part defining a folding line, the flat sheet part unconjoined to the short sides of the fitted sheet part, and the length of the long side of the flat sheet part exceeding the length of the sewn fitted sheet part, and the short sides of the flat sheet part each exceeding the width of the short sides of the sewn fitted sheet part, and the flat sheet part assuming a first position for the covering of a sleeping person and assuming a second position in which the flat sheet part covers over back cushions of the sofa; and, the folding line being parallel to the long side of the fitted sheet part along which line said flat sheet part is foldably swept between the first position and the second position, and the flat sheet part while in the second position covering the entirety of the back cushions in which the long side is capable of assuming a position substantially parallel to the folding line.

10. The sofa protector of claim 9 wherein an elastic band is sewn along said four corners and entire length of said long side of said fitted sheet part and along said folding line where said fitted sheet part and said flat sheet part are conjoined.

11. The sofa protector of claim 9 wherein said sofa protector is constructed of at least one piece of fabric.

12. The sofa protector of claim 9 wherein said fitted sheet part has an integrated sewn in pocket to accommodate a variety of throw pillows.

13. The sofa protector of claim 9 with an added four sided pillow case to retain variously shaped couch or throw pillows.

14. The sofa protector of claim 9 wherein the fitted sheet part is padded with a quilted layer.

15. A one-piece protector and bedding substitute for sofas having back cushions and seat cushions comprising:

a panel logically divided into, (i) a fitted sheet part having sewn mitered corners with elastic about the perimeter thereabout for the reception of corners of the seat cushions; and, (ii) a flat sheet part exceeding the length of the fitted sheet, and contiguous with the fitted sheet and having a first position in which the flat sheet part covers a sleeping person, and a second position in which the fiat sheet part covers the back cushions of a sofa for the protection thereof; and the fiat sheet part solely conjoined to the fitted sheet part longitudinally along a straight folding line, and along which line the fiat sheet part is foldably swept between the first and second positions.

16. The sofa protector according to claim 15 in which the fitted sheet part is padded with a quilted layer.

17. The sofa protector according to claim 15 in which the fitted sheet part has a rectangular pocket sewn on the surface for the reception of a pillow.

* * * * *